US006756954B2

(12) United States Patent
Yamamoto et al.

(10) Patent No.: US 6,756,954 B2
(45) Date of Patent: Jun. 29, 2004

(54) LIQUID CRYSTAL DISPLAY APPARATUS

(75) Inventors: Tsunenori Yamamoto, Hitachi (JP); Nobuyuki Suzuki, Mobara (JP); Makoto Tsumura, Hitachi (JP); Ikuo Hiyama, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 161 days.

(21) Appl. No.: 09/809,069

(22) Filed: Mar. 16, 2001

(65) Prior Publication Data

US 2002/0047818 A1 Apr. 25, 2002

(30) Foreign Application Priority Data

Mar. 17, 2000 (JP) ..... 2000-081721
Oct. 24, 2000 (JP) ..... 2000-329779

(51) Int. Cl.[7] ..... G09G 3/18
(52) U.S. Cl. ..... 345/87; 345/94
(58) Field of Search ..... 345/87, 90, 92, 345/91, 94, 96, 99, 100, 98, 50; 349/33, 34, 42, 41; 348/792

(56) References Cited

U.S. PATENT DOCUMENTS 4,455,576 A * 6/1984 Hoshi ..... 348/792
5,949,391 A * 9/1999 Saishu et al. ..... 345/50
6,243,064 B1 * 6/2001 Hirakata ..... 345/96
6,456,266 B1 * 9/2002 Iba et al. ..... 345/87

FOREIGN PATENT DOCUMENTS

JP 9265112 10/1997
JP 11109921 4/1999

* cited by examiner

*Primary Examiner*—Chanh Nguyen
(74) *Attorney, Agent, or Firm*—Antonelli, Terry, Stout & Kraus, LLP

(57) ABSTRACT

A liquid crystal display apparatus for high quality moving image is provided. Such a liquid crystal display apparatus comprises a pair of substrates, at least one of which is transparent; a liquid crystal layer interposed between said pair of substrates; first scanning lines and signal lines arranged in a matrix form; first active elements, each formed proximate to a crossing point of a corresponding signal line and a corresponding first scanning line, pixel electrodes connected to the first active elements, common lines arranged in parallel with the first scanning lines, and opposed electrodes connected to the common lines, are arranged on one of said pair of substrates, and a liquid crystal display is provided in the liquid crystal layer by a voltage applied to the pixel electrodes and opposed electrodes; and second active elements connected to the opposed electrodes, the pixel electrodes corresponding to the opposed electrodes, and second scanning lines different from the first scanning lines connected through the first active elements to the pixel electrodes, wherein the first active elements are driven by a selection pulse to write an image signal in the pixel electrodes and a selection pulse to display the following image, and the second active elements are driven by a clear pulse to clear the image signal applied to the pixel electrodes.

9 Claims, 11 Drawing Sheets

LIQUID CRYSTAL DISPLAY APPARATUS

BACKGROUND OF THE INVENTION

The present invention relates to an active matrix type liquid crystal display apparatus.

Recently, the liquid crystal display apparatus is being applied as a display mainly composed of the motion picture such as a liquid crystal TV. However, the deterioration of the picture quality of the motion picture (hereafter, motion picture quality) in the liquid crystal display apparatus is reported at Institute of Telecommunications Engineers technical report EID96-4, pp.19–26(1996-06), etc.

According to this, the motion picture is to deteriorate because the liquid crystal display is a holding luminescence type display, and growing dim is generated in the moving image by the disagreement of the moving image to which the holding luminescence is done and the glance movement by man's motion picture follow seeing. In order to improve the deterioration in the quality of this motion picture, the method of making the frame frequency n times speed. The method of making the image display 1/n frame period and setting the period of the remainder to be a blanking display has been also described. Where, the larger the numerical value of n, the more it is effective to the motion picture which moves at a high speed.

A method of improving the quality of the motion picture is described, for example, in the Japanese Patent Application Laid-open No. 11-109921. According to the Official Gazette, the signal line drive circuits are provided at the upper part and the bottom part of the liquid crystal panel, the scanning line is selected twice while one screen is displayed, the display image writing and the blanking image writing is performed by using the upper and the lower signal line drive circuit, respectively, and about the half of one screen period is used for the image display and the remaining half for a blanking display.

However, the parts cost is high because expensive signal line drive circuits are used at both the upper part and the bottom part of the liquid crystal panel in the method disclosed in Japanese Patent Application Laid-open No. 11-109921, and thus the liquid crystal display also becomes expensive.

Moreover, when the display speed of the motion picture (movement speed on the screen) is fast, the improvement effect of the display characteristic is insufficient in the method of setting half one screen cycle to be a blanking display like this prior art.

SUMMARY OF THE INVENTION

An object of the present invention is to provide the liquid crystal display which obtains an excellent display characteristic even when the motion picture is displayed.

The feature according to one embodiment of the liquid crystal display of the present invention resides in that a liquid crystal display apparatus comprising: a pair of substrates, at least one of which is transparent; a liquid crystal layer interposed between said pair of substrates; a plurality of scanning electrode lines and a plurality of signal electrode lines formed so as to cross each other in a matrix form; active elements, each formed proximate to each of the crossing points of said corresponding signal lines and said scanning lines, pixel electrodes connected to said active elements, common lines formed between each of said scanning lines, and opposed electrodes, each formed between said pixel electrodes and each connected to said common lines, are arranged on one of said pair of substrates; said liquid crystal display apparatus displaying with moving the liquid crystal molecule in the liquid crystal layer by the voltage applied to said pixel electrodes and said opposed electrodes. The apparatus further comprising: a plurality of second active elements connected to said plural opposed electrodes, said plural pixel electrodes corresponding to the opposed electrodes, and second scanning lines different from said scanning lines connected through said active elements to the pixel electrodes, and wherein common lines corresponding to said pixel electrodes are selected between the selection pulse of the scanning line to write the picture signal in said pixel electrode and the selection pulse of said scanning line to display the following images and a pulse to clear the picture signal applied to said pixel electrode is applied.

Further, such a liquid crystal display has a display mode of a normally black characteristic in which the black is displayed when a voltage is not applied to the liquid crystal.

DETAILED DESCRIPTION OF THE PREFERRED EMBODIMENT

Hereafter, the present invention is concretely explained with reference to the embodiment.

(Embodiment 1)

Figure 2:
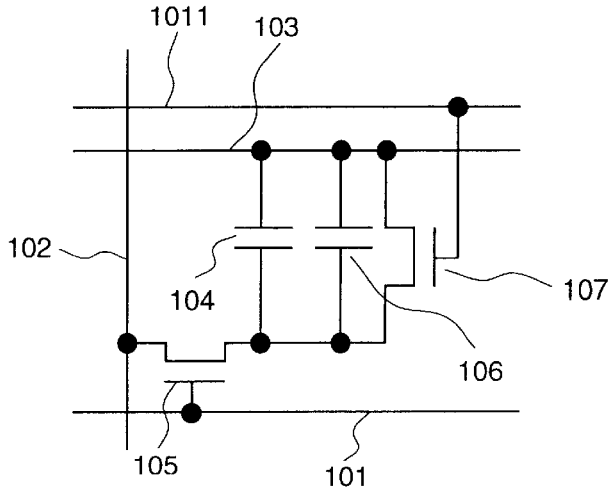
FIG. 2 shows an equivalent circuit in the pixel part of the active matrix type liquid crystal display apparatus apparatue of the embodiment 1.

Circuit diagram of the pixel in an active matrix type liquid crystal display apparatus according to the present embodiment is shown in FIG. 2.

In FIG. 2, scanning line 101 and signal line 102 are formed like the matrix. Active element 105 is arranged at those intersections so that scanning line 101 may act as a gate terminal. When the selection pulse (a certain voltage value) which is a control signal is given to scanning line 101, active element 105 writes the electric potential which is a control signal of signal line 102 in liquid crystal 104 and retention volume 106. Moreover, the active element 105 operates to maintain the potential of the liquid crystal 104 and retention volume 106 when non-selection voltage which forms a control signal is given to the scanning line 101. In the liquid crystal 104, the direction of orientation changes depending on the potential difference between the potential of the common line 103 and the potential written with the active element 105. Therefore, the transmittivity of the pixel changes as a result.

The above is a pixel circuit of a normal active matrix type liquid crystal display apparatus.

Further, in this embodiments there is provided a second active element 107 in which scanning line 1011 at the former stage acts as a gate terminal, and the terminals at the side of the liquid crystal 104 of common line 103 and active element 105 act as source and drain terminals.

Figure 16:
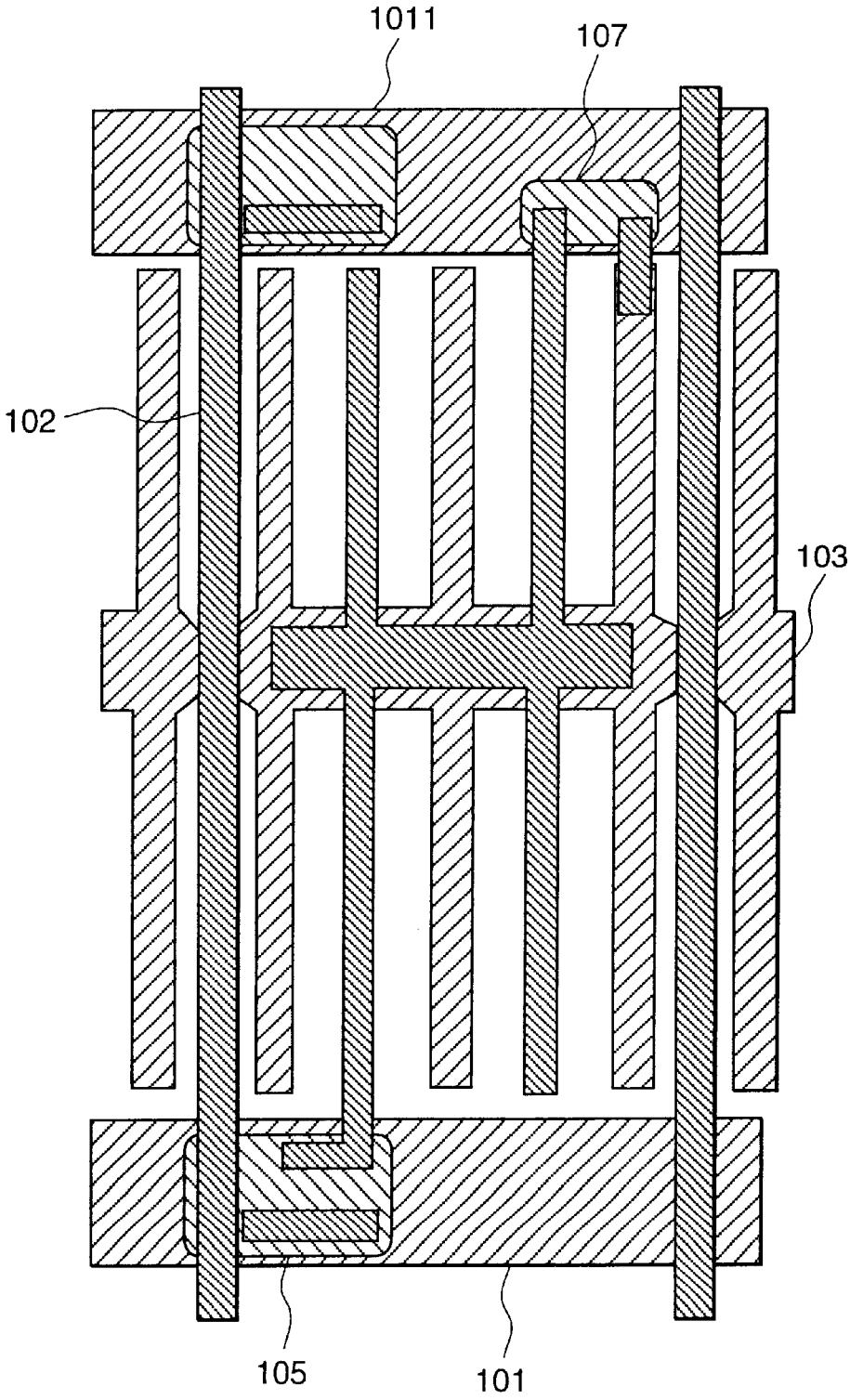
FIG. 16 shows the pixel structure of the embodiment 1.

An example of the pixel structure in this embodiment is shown in FIG. 16.

Even if scanning line's 101 in the former steps not only being selected but also common line 103 is selected, this second active element 107 becomes equal in case of the case for scanning line 101 in the former steps to be selected relatively by the capacitive coupling. Therefore, this second active element operates to cancel the potential difference applied to liquid crystal 104.

Because the liquid crystal with a normally black characteristic by which the black is displayed with the voltage not applied is used as the liquid crystal 104 in this embodiment, the pixel enters the state of a black display when this second active element 107 operates and the voltage applied to liquid crystal 104 is canceled.

Figure 1:
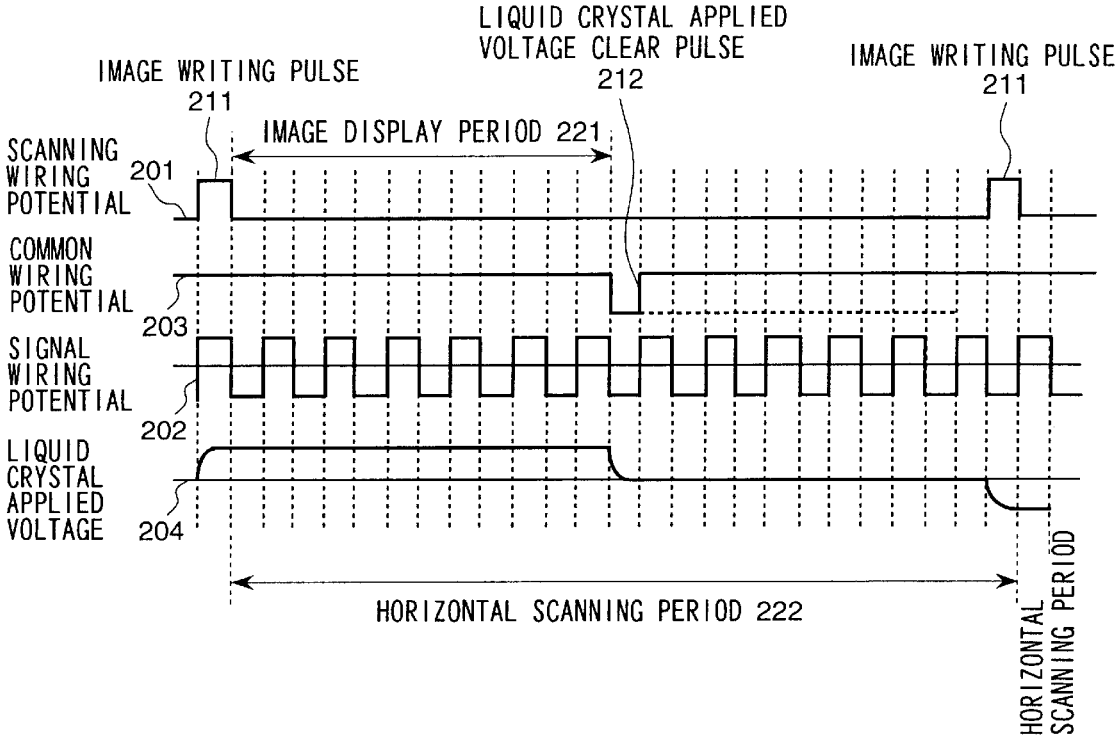
FIG. 1 shows a method of applying the voltage to each line of an active matrix type liquid crystal display apparatus of embodiment 1.

Next, the voltage applied to each line of this pixel structure is shown in FIG. 1.

As shown in FIG. 1, a display method is used in this embodiment to improve the quality of the motion picture, in which the image is displayed only for a part of period of one vertical scanning period 220 (=one image rewriting cycle) and a blanking display by a black display is carried out for the remaining period. In more detail, the display of the image starts after image writing pulse 211 is applied to scanning line potential 201, the active element 105 of FIG. 2 is activated, and signal line potential 202 is applied to the liquid crystal 104. Further, because the second active element 107 shown in FIG. 2 operates by liquid crystal applied voltage clear pulses 212 being applied to common line potential 203, and the voltage applied to liquid crystal 104 is canceled, the image becomes the blanking display of a black display.

In a word, period 221 when the image is displayed is a period from the apply of image writing pulse 211 to the apply of liquid crystal applied voltage clear pulse 212. The liquid crystal applied voltage clear pulse 212 has about 1H period as shown in FIG. 2 by a solid line. Moreover, the period of the liquid crystal applied voltage clear pulse may be the period just before the following image writing pulse 211 as shown by the dotted line, in order to cancel sufficiently the liquid crystal applied voltage. In addition, the voltage of the liquid crystal applied voltage clear pulse 211 is not necessary to be a constant, and may make the voltage value of the liquid crystal applied voltage clear pulse 211 change during the pulse period to suppress the variation of the voltage caused by the operation of the second active element 107.

Figure 3:
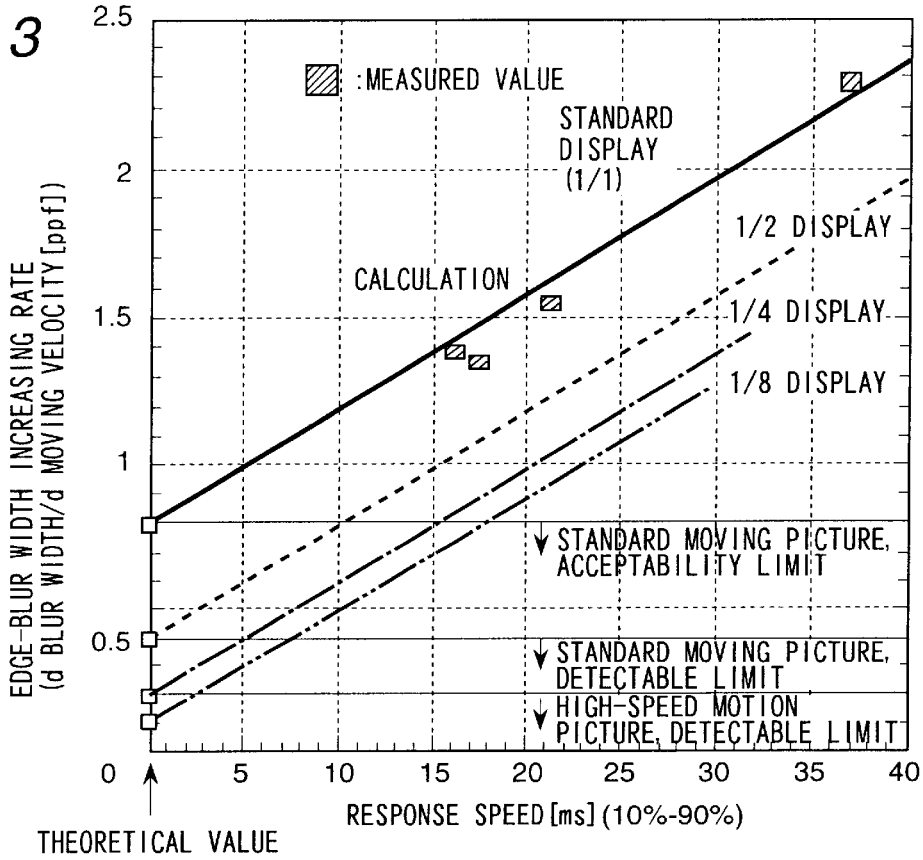
FIG. 3 shows an image display period and a speed of response of the liquid crystal, necessary to display the motion picture appropriately.

Here, in order to improve the performance of the motion picture display, it is necessary to reduce the ratio of the image display period 221 to the vertical scanning period 220 and improve the response characteristic of the liquid crystal. The response speed of the liquid crystal and the ratio of the image display period 221 to display the motion picture with a different pen up speed appropriately was clarified from motion picture quality measurement of the liquid crystal display by the time series image integration which we developed, and from the Institute of Telecommunications Engineers technical report EID96-4, pp.19–26(1996-06), etc. This is shown in FIG. 3.

According to this figure, it is necessary that the image display period 221 is ½ or less of the vertical scanning period 220 and the response speed of the liquid crystal is less than 10 msec to improve the motion picture quality to the extent that a standard motion picture of about 10 deg/sec which frequently comes out in TV telecast can be allowed.

Further, it is necessary that the image display period 221 is ¼ or less of the vertical scanning period 220 and the response speed of the liquid crystal is less than 5 msec to improve the motion picture quality to the extent that the deterioration of a standard motion picture of about 10 deg/sec which frequently comes out in TV telecast cannot be detected.

It is necessary that the image display period 221 is ⅛ or less of the vertical scanning period 220 and the response speed of the liquid crystal is less than 3 msec to improve the motion picture quality to the extent that the deterioration of a high-speed motion picture of about 20 deg/sec which frequently comes out in TV telecast cannoto be detected.

In this embodiment, liquid crystal applied voltage clear pulse 212 has been adjusted so that image display period 221 may become ⅛ at the vertical scanning period 220. In addition, the speed of the response of the liquid crystal material at about 3 msec in this embodiment. Therefore, the deterioration of the quality of the motion picture cannot be detected even when the high-speed motion picture is displayed.

Figure 4:
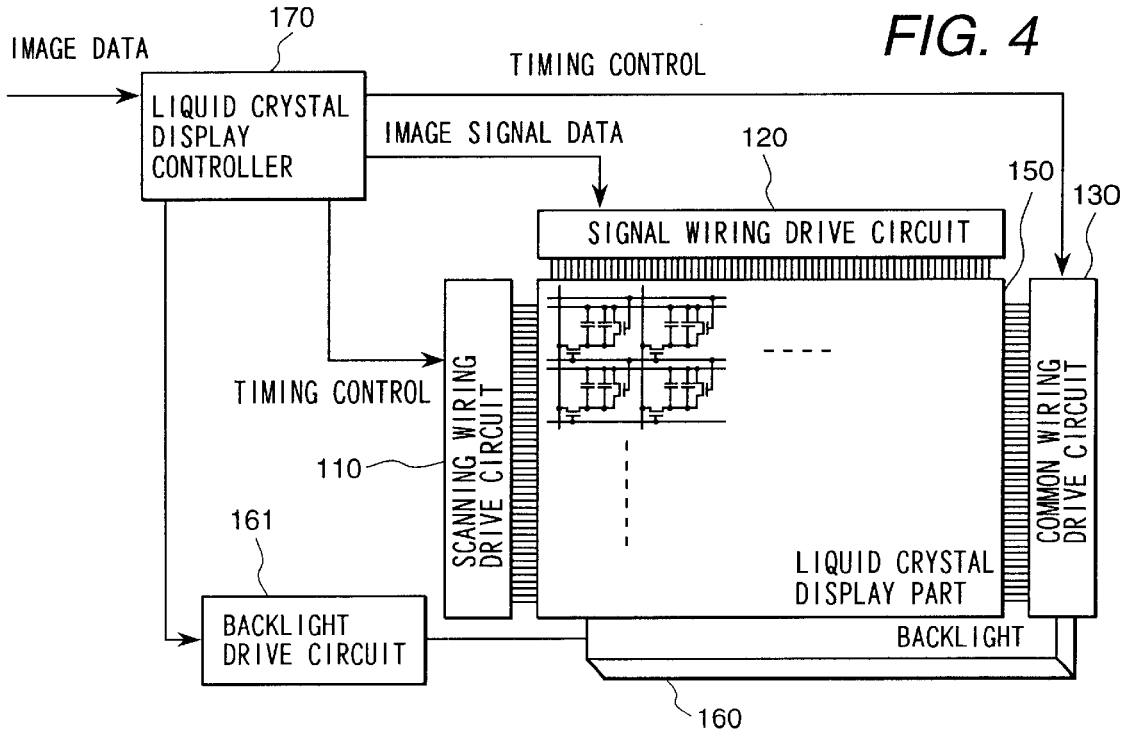
FIG. 4 is a block diagram showing the active matrix type liquid crystal display apparatus of the embodiment 1.
Figure 5:
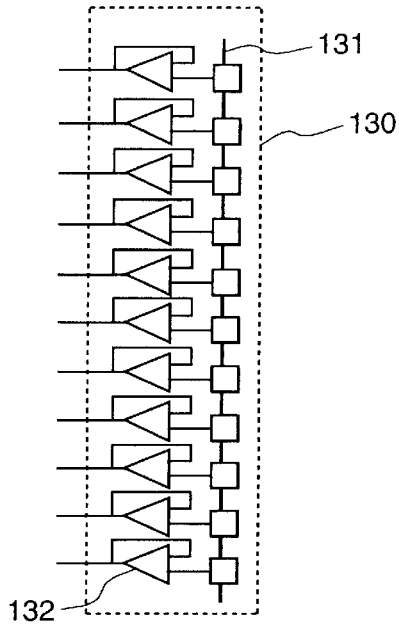
FIG. 5 shows an internal composition of a common line drive circuit of the active matrix type liquid crystal display apparatus of the embodiment 1.

The block diagram of an active matrix type liquid crystal display apparatus in this embodiment is shown in FIG. 4. The image data output from the image output source is input to liquid crystal display controller 170, and control signals such as the timing control signal and the image data signal are output from the controller 170 to scanning line drive circuit 11, the signal line drive circuit 120, and common line drive circuit 130. To adjust the image display period 221 to ⅛ of the vertical scanning period 220, liquid crystal display controller 170 outputs the black display writing pulse control signal output to common line drive circuit 130, delaying by ⅛ vertical scanning cycles than the image writing pulse control signal output the scanning line drive circuit 110. As shown in FIG. 5, common line drive circuit 130 comprises mainly shift register 131 and amplifier circuit 132. Therefore, quite the same IC as the circuit used for scanning line drive circuit 110 can be used.

An IC for this scanning line drive circuit 110 is more low-cost than IC for signal line drive circuit 120. Moreover, compared with the configuration in that two set of ICs for the signal line drive circuit are arranged in the top and bottom of liquid crystal display 150, the configuration in that two set of ICs for the scanning line drive circuit are arranged in the right and left of liquid crystal display 150 is more low-cost because the number of IC used is decreased.

Even if the motion picture with a fast pen up speed is displayed, an excellent display performance is obtained in this embodiment, since the liquid crystal with the response speed being about 3 msec is used, and the image display period is set to be ⅛ of one frame (vertical scanning period). Moreover, because in order to realize such a circuit structure, not two set of IC for the signal line drive circuit but two set of IC for the scanning line drive circuit is used, it is possible to compose the display at more low-cost.

(Embodiment 2)

This embodiment has the same configuration as embodiment 1, except for the following points.

With regard to the timing of liquid crystal applied voltage clear pulse 212 in this embodiment, image display period 221 is not fixed to the ⅛ vertical scanning period, and is changeable according to the control signal from the liquid crystal display controller 170. That is, the ratio of the image display period 221 to the vertical scanning period 220 can be changed in real time.

As described above, it is possible to improve the picture quality of the motion picture which moves at a high-speed by reducing the ratio of the image display period 221. However, as for the display of the static picture, the larger the ratio of the image display period 221 is, the fewer the flicker. The picture with high resolution can be obtained as a result. Moreover, in the case that the ratio of the image display period 221 is large, the amount of luminescence of a lighting unit necessary to display with the same brightness is decreased, and thus power consumption can be reduced.

Therefore, the pen up speed of the object in the displayed screen is judged in liquid crystal display controllers 170, the timing at which liquid crystal applied voltage clear pulse 212 in the one vertical scanning period is applied is changed at the time of each rewriting by one screen, and the ratio of the image display period 221 in one vertical scanning period 220 is adjusted in this embodiment. As a result, common line drive circuit 130 is controlled so that the picture quality of displayed motion picture or static picture may become suitable for display. At the same time, liquid crystal display controller 170 adjusts the brightness of the back light by controlling back light control circuit 161 so that the display brightness should not change even if image display period 221 changes.

Figure 6:
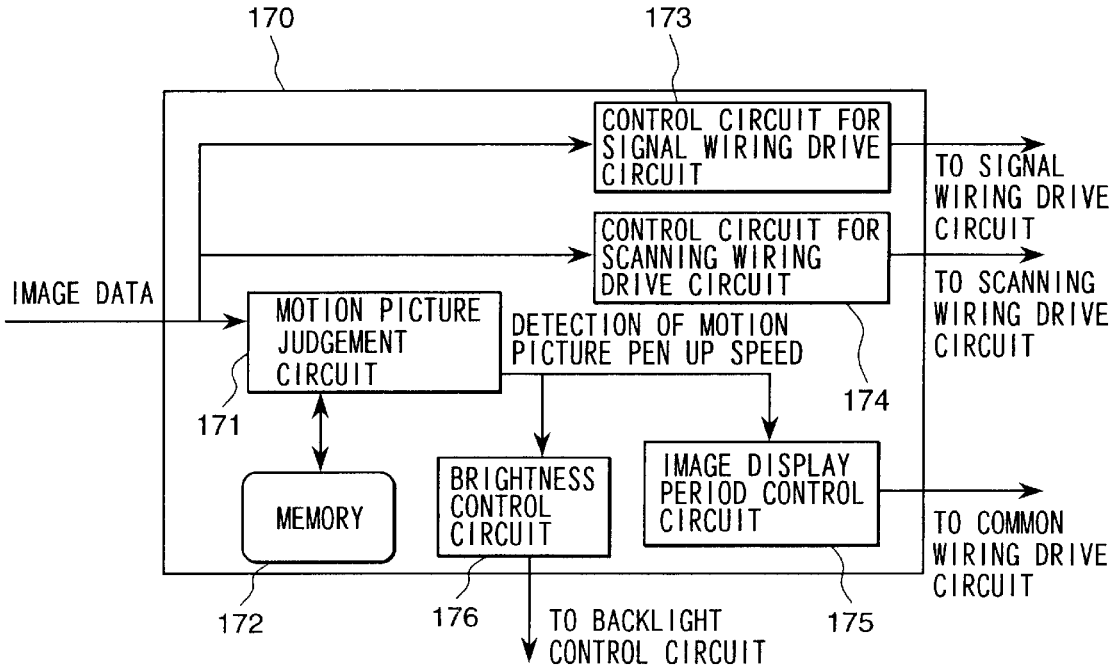
FIG. 6 is a block diagram showing a liquid crystal display controller of an active matrix type liquid crystal display apparatus of embodiment 2.

Although the block diagram of an active matrix type liquid crystal display apparatus according to this embodiment is the same as embodiment 1, the configuration of the liquid crystal display controller 170 is different from that of embodiment 1. The configuration of the liquid crystal display controllers 170 is shown in FIG. 6. First of all, control circuit 173 for the signal line drive circuit and control circuit 174 and the control circuit 174 for the scanning line drive circuit outputs an image data signal and a timing control signal to the signal line drive circuit and the scanning line drive circuit respectively, based on the image data from the image output source. Although the above-mentioned configuration is the same as that of a usual liquid crystal display controller in the liquid crystal display controller 170 of this embodiment, the pen up speed of the object in the image is detected by comparing the image data from the image output source with the previous image data by one screen stored in memory 172 by using motion picture judgement circuit 171. Image display period control circuit 175 controls the power output timing to common line drive circuit 130 by using the result of this detection, and changes the image display period from ⅛ of the vertical synchronization periods to 1/1. At the same time, brightness control circuit 176 changes the brightness of the back light from 1 to ⅛ times. As a result, the image display period is adjusted to ⅛ when the motion picture with a fast pen up speed is displayed, and the motion picture without the motion picture quality deterioration is displayed when the static picture almost without movement is displayed, the image display period is set to be 1/1, and the brightness of the back light 118. As a result, still picture with high resolution and with few flickers can be displayed.

As described above, even if not only the motion picture with a fast pen up speed but also the static picture is displayed, an excellent display performance is obtained in this embodiment. Moreover, since an increase in components of the circuit to achieve the above apparatus is few, it is possible to make such an apparatus at low-cost. In addition, when the image with a low pen up speed is displayed, power consumption becomes low.

Although the brightness of the back light and the image display period are controlled by detecting the pen up speed of the object in the image by using the motion picture judgment circuit 171, based on the image data from the image output source, if the image output source can output simultaneously with the image output a signal indicative of the pen up speed of the object in the image, it is possible to control the brightness of the back light and th image display period by using the signal.

(Embodiment 3)

This embodiment has the same configuration as embodiment 2, except for the following points.

Figure 7:
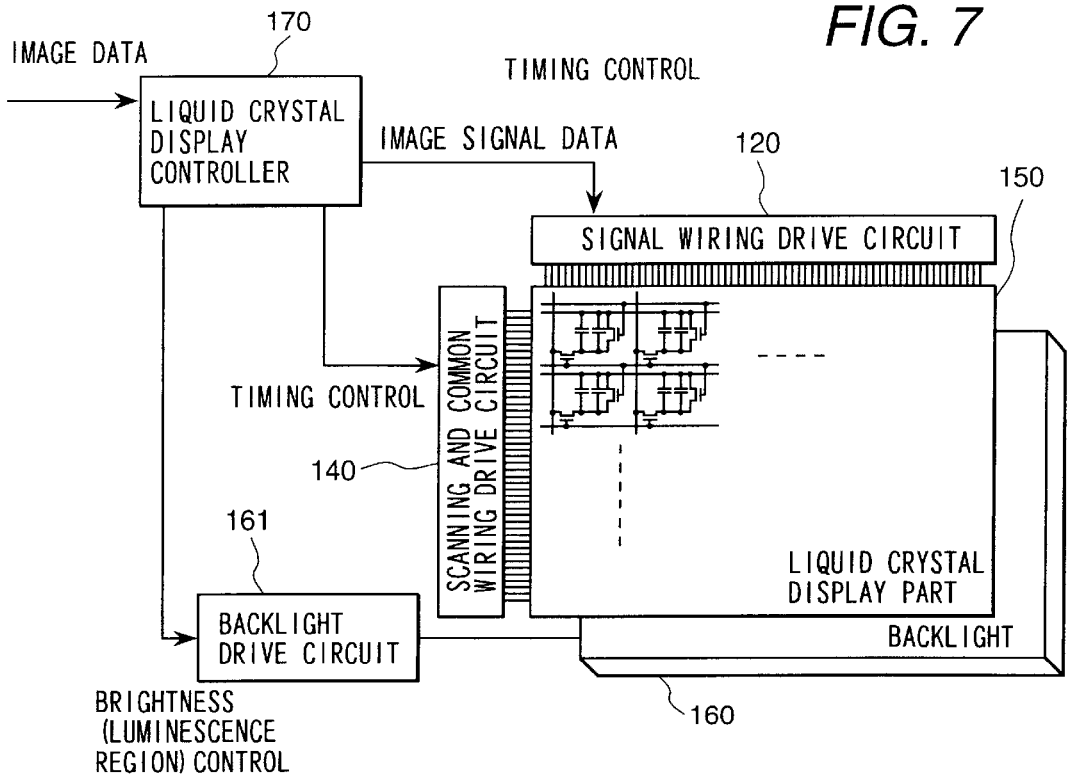
FIG. 7 is a block diagram showing an active matrix type liquid crystal display apparatus of embodiment 3.

In this embodiment, by assembling the scanning line drive circuit 110 and the common line drive circuit 130 which have been divided into the right and left of the liquid crystal display part 150 in the embodiment 2 together as a one circuit, they are arranged in the one side of liquid crystal display 150 as scanning and common line drive circuit 140 as shown in FIG. 7.

Figure 8:
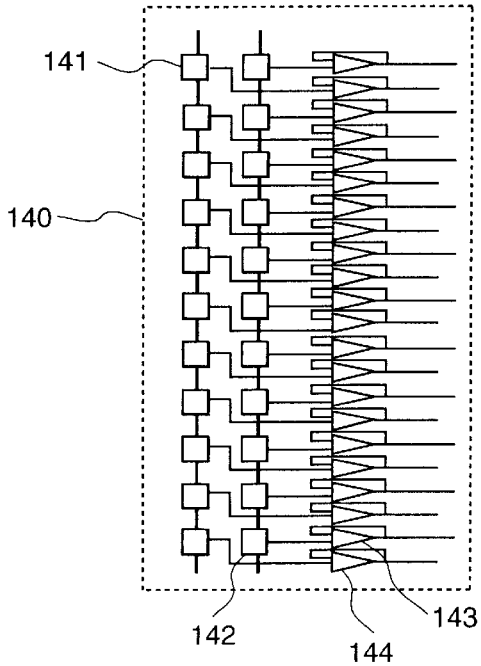
FIG. 8 shows an internal composition of a scanning and common line drive circuit of the active matrix type liquid crystal display apparatus of the embodiment 3.

An internal composition of this scanning and common line drive circuit 140 is shown in FIG. 8. it comprises shift register 141 for the scanning line selection and amplifier circuit 144, and shift register 142 for the common line selection and the amplifier circuit 143, in which the output terminal for the scanning line drive and the output terminal for the common line drive are arranged at intervals of one line. The number of output terminals as one IC chip is the same as the IC for the scanning line drive used in the embodiment 2. However, because the IC is mounted only on the one side of the liquid crystal display, the cost of the PCB substrate for connecting the IC and the cost for mounting, etc. can be decreased.

Figure 9:
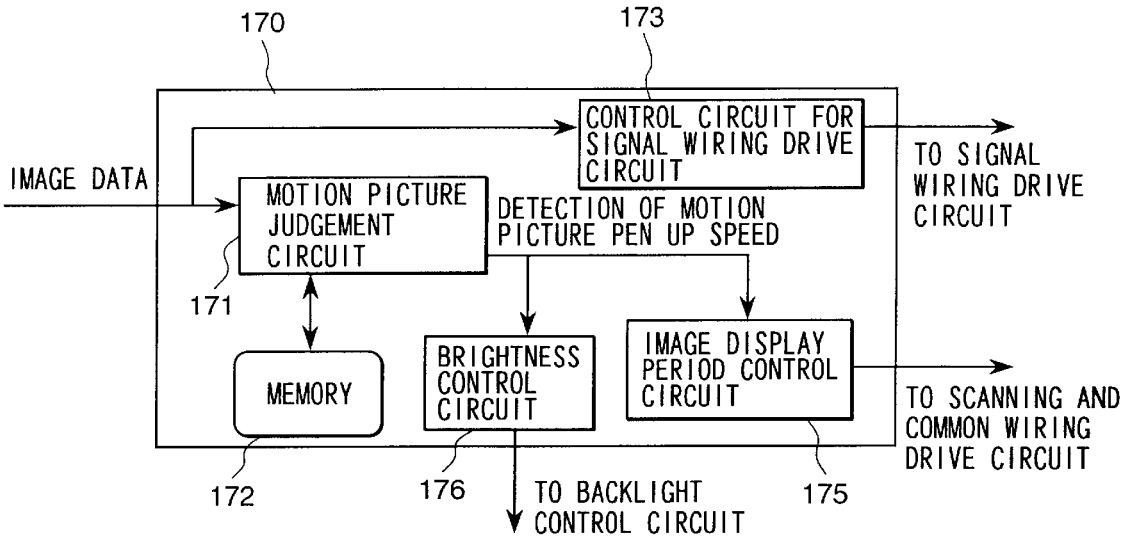
FIG. 9 is a block diagram showing the liquid crystal display controller of the active matrix type liquid crystal display apparatus of the embodiment 3.

Liquid crystal display controller 170 of this embodiment is shown in block diagram of FIG. 9. In this embodiment, the control circuit 174 for the scanning line drive circuit is eliminated, and image display period control circuit 175 controls the scanning and common line drive circuit 140 directly.

Accordingly, it is possible to obtain an excellent display performance in this embodiment, even if not only the motion picture with a fast pen up speed but also the static picture is displayed. When the image with a low pen up speed is displayed, it becomes possible to decrease the parts cost and the product cost further.

(Embodiment 4)

This embodiment has the same configuration as embodiment 2, except for the following points.

Figure 10:
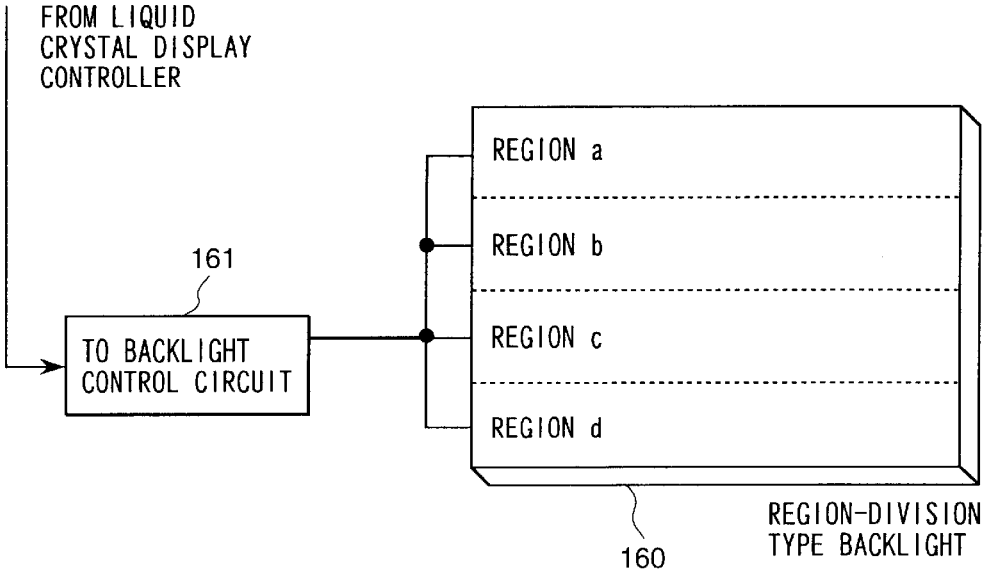
FIG. 10 shows a back light part of an active matrix type liquid crystal display apparatus of embodiment 4.

In this embodiment, a luminescence-region-division type back light is used as a light source or back light 160 as shown in FIG. 10.

Figure 11:
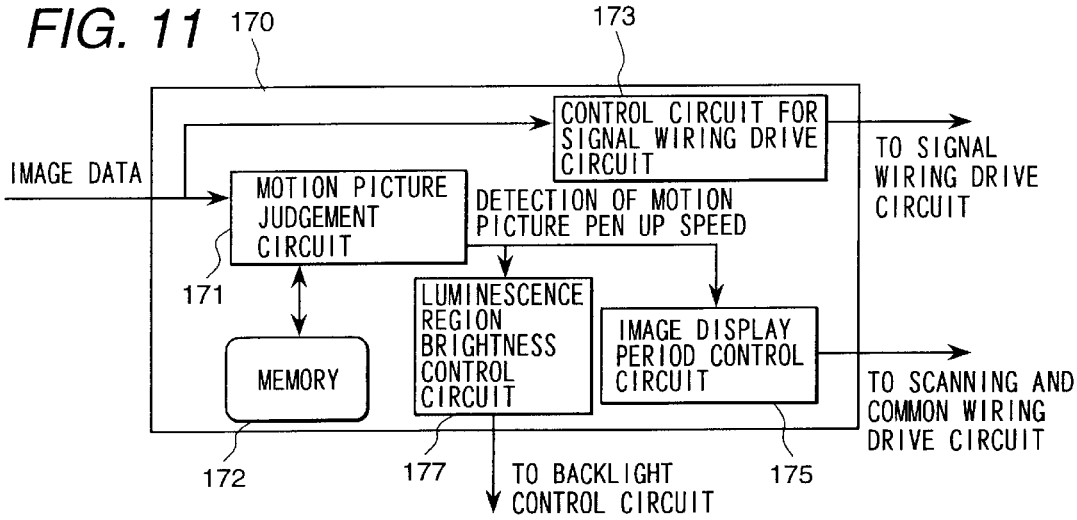
FIG. 11 is a block diagram showing a liquid crystal display controller of the active matrix type liquid crystal display apparatus of the embodiment 4.

Power consumption can be decreased by turning on only the region necessary for displaying the image and turning off other regions when the image display period is shortened to display the motion picture with a fast pen up speed, in the case that and the back light with such a region which emits light being divided, which can separately control brightness, is used. For this, it is necessary to adjust the luminescence portion and the brightness of back light 160 in accordance with the image display period. In the liquid crystal display controller 170 of this embodiment shown in FIG. 11, the luminescence region and the brightness of the back light are controlled by brightness control circuit 177 in syncronization with the control of the image display period due to the display period control circuit 175, based on the result of detection of the motion picture pen up speed by the motion picture judgement circuit 171.

Although the luminescence region of the back light is separated to four regions in this embodiment, the number of division of regions is optional. Further, if it is possible to divide the region, a front light or a side light can be used.

Accordingly, it is possible to obtain an excellent display performance in this embodiment, even if not only the motion picture with a fast pen up speed but also the static picture is displayed. When the image with a low pen up speed is displayed, it becomes possible to decrease the parts cost and the product cost further.

Although the brightness and the luminescence regions of the back light, and the image display period are controlled by detecting the pen up speed of the object in the image by using the motion picture judgment circuit 171, based on the image data from the image output source, if the image output source can output simultaneously with the image output a signal indicative of the pen up speed of the object in the image, it is possible to control the brightness of the back light and th image display period by using the signal.

(Embodiment 5)

The difference between the embodiment 1 and the present embodiment 5 is as follows.

Figure 12:
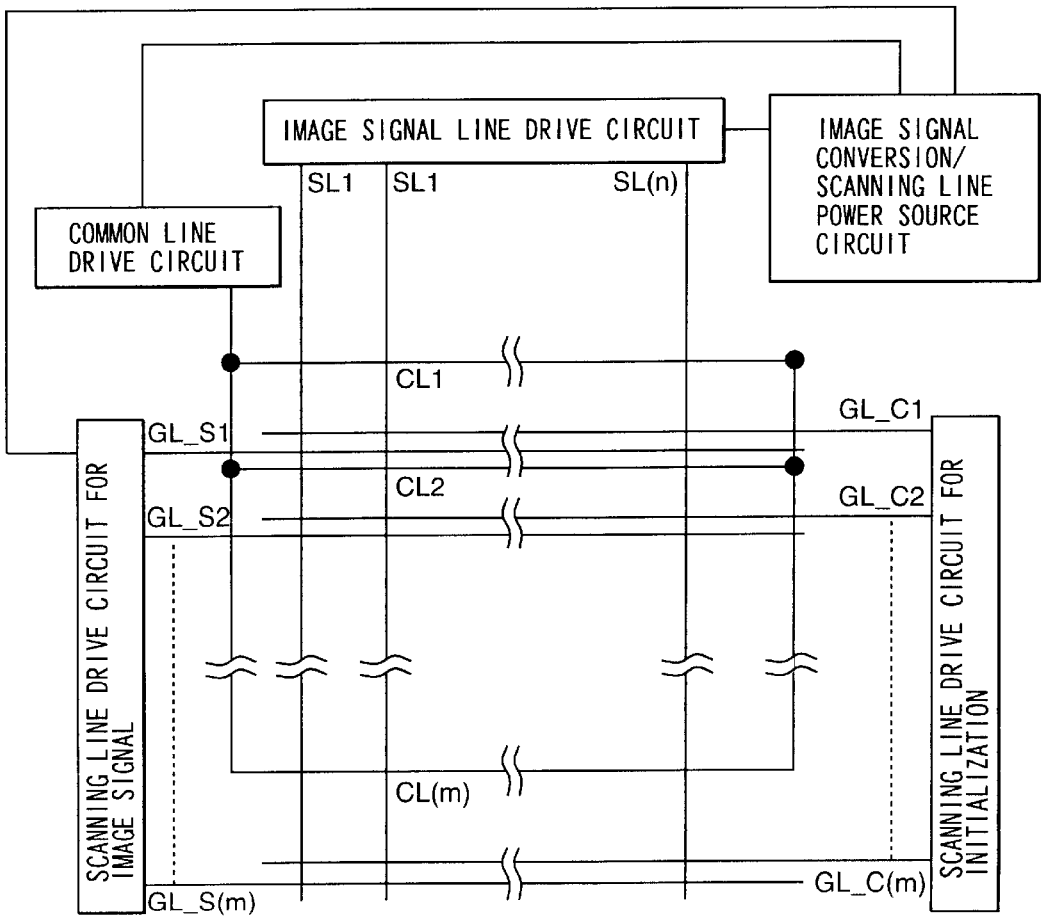
FIG. 12 is an electric imitative chart of the liquid crystal display of embodiment 5.

FIG. 12 is an electric imitative chart of the liquid crystal display of embodiment 5. M scanning lines GL_S1–GL_S(m) for the video signal, m scanning lines GL_C1–GL_C(m) for initialization, n video signal lines SL1–SL(n) and m common lines CL1–CL(m) are formed on the active matrix substrate. The scanning lines for the video signal, the scanning lines for the initialization and the video signal lines are drawn out to the surroundings of the active matrix substrate, and connected electronically to the scanning line drive circuit for the video signal, the scanning line drive circuit for the initialization and the video signal line drive circuit. The common line is connected in a part outside the display region of the active matrix substrate, and after being drawn out to the surroundings of the active matrix substrate, it is connected to the common drive circuit. Each drive circuit is connected to each of the circuits for carrying out the video signal conversion, the scanning signal conversion and the power supply generation.

Figure 13:
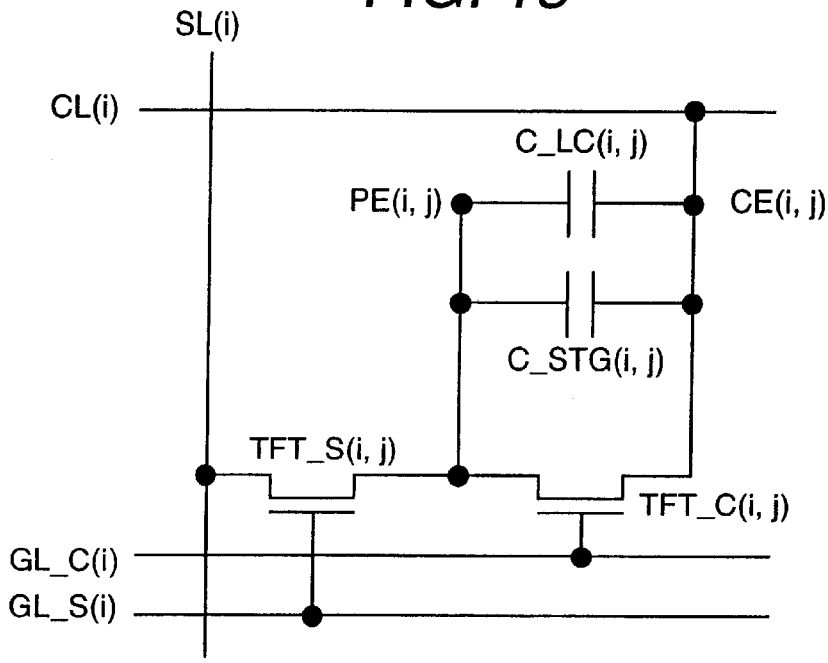
FIG. 13 shows an electric equivalent circuit of the pixel of embodiment 5.

An electric equivalent circuit of the pixel at i-line and j-row formed on the active matrix substrate is shown in FIG. 13. A source electrode of thin film transistor TFT_S(i,j) for the video signal is connected to video signal line SL(j), its gate electrode is connected to scanning lines GL_S(i) for the video signal line, and its drain electrode is connected to pixel electrode PE(i,j). A source electrode of thin film transistor TFT_C(i,j) for initialization is connected to common line CL(i), its gate electrode is connected to scanning lines GL_C(i) for initialization, and its drain electrode is connected to pixel electrode PE(i,j) Pixel electrode PE(i,j) and common electrodes CE(i,j) connected with common line CL(i) form capacity C_LC(i,j) of the liquid crystal through the liquid crystal sandwitched between their electrodes.

At this time, the processing is performed so that the liquid crystal may orient in a predetermined direction on the faces opposed to each other of said two substrates.

It is possible to modulate the light passed through the liquid crystal display apparatus, by providing one polarizing plate with the transmission axis being parallel with the orientation direction of the liquid crystal on the face not opposed to each other of one sustrate, and another polarizing plate with the transmission axis being orthogonal to the orientation direction of the liquid crystal on the face not opposed to each other of the other substrate in said two substrates. More concretely, the liquid crystal display apparatus becomes of a so-called, normally-black type in which the light does not pass when the voltage is not applied to the liquid crystal, and and the light can pass when the electric field is applied to the liquid crystal by providing the potential difference between the pixel electrode and the common electrode.

Figure 14:
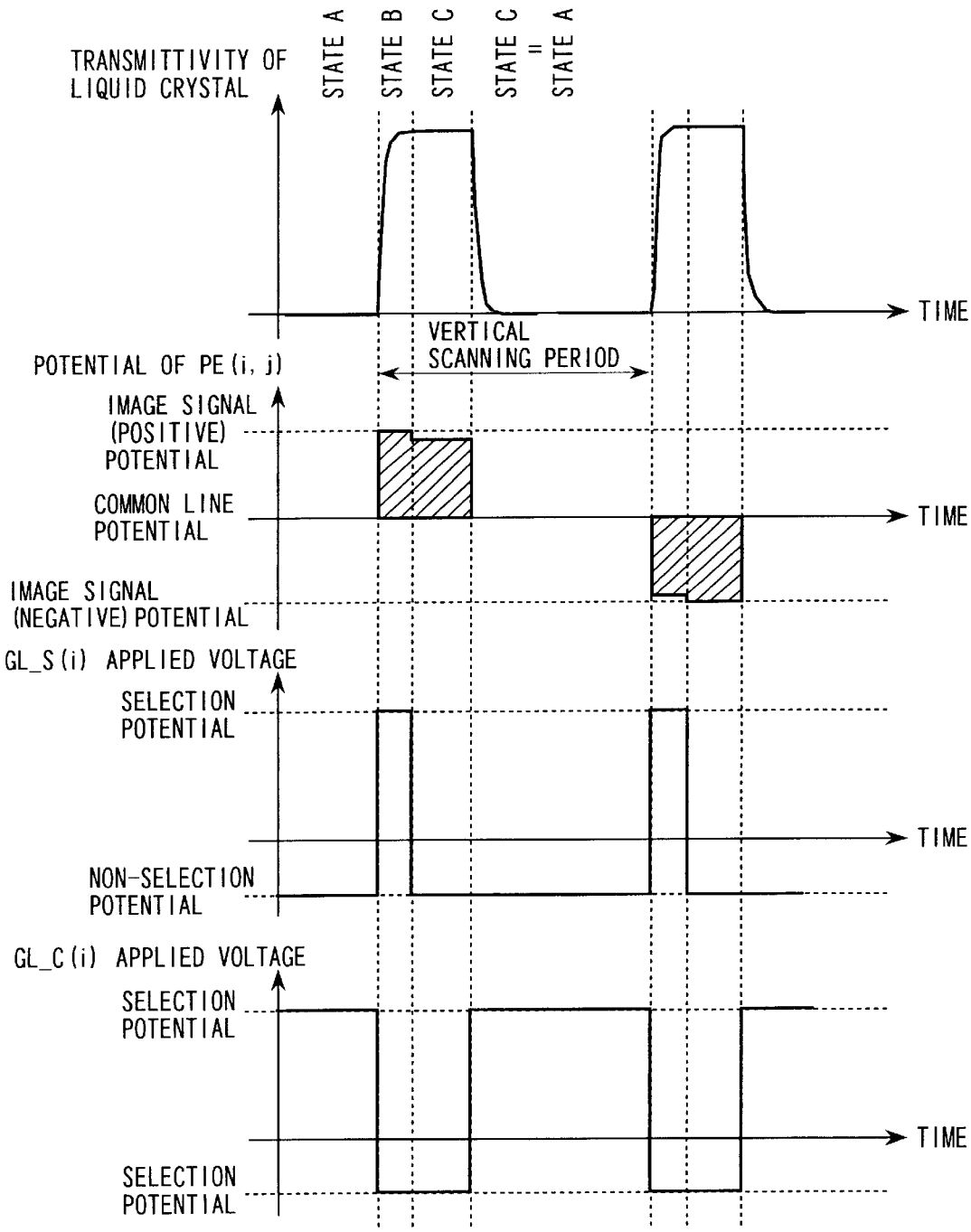
FIG. 14 shows the change in transmittivity of the liquid crystal display apparatus and the waveform of the voltage applied to the circuit of FIG. 13.

FIG. 14 shows the waveform of the voltage applied to the circuit of FIG. 13 and the time-varied transmittivity of the liquid crystal display.

The relationship between the applied voltage waveform and the transmittivity of the liquid crystal display apparatus is as follows.

(state A) the thin film transistor TFT C(i,j) for initialization is in the state of the selection, and its pixel electrode and common electrode are at the same potential. Under such a condition, there is no polarization conversion efficiency of the liquid crystal. Therefore, the light injected into the liquid crystal display apparatus is prevented by the polarizing plates of which the transmission axes are orthogonal to each other. Accordingly, the light cannot pass through the liquid crystal display apparatus (black state). The thin film transistor TFT_C(i,j) for initialization is set to be at a non-selection state immediately before the pixel signal is written in pixel electrode PE(i,j), and pixel electrode PE(i,j) and common electrode CE(i,j) are insulated electrically.

(state B) Scanning lines GL_S(i) for the video signal line are selected, and the picture signal applied to video signal line SL(i) is written in pixel electrode PE(i,j).

(state C) Scanning lines GL_S(i) for the video signal line are set to be at a non-selection state, and pixel electrode PE (i,j) and video signal line SL(i) are insulated electrically to each other. As a result, the picture signal is held in pixel electrode PE(i,j), and the liquid crystal rotates on the plane parallel to the active matrix substrate by the electric field generated by the potential difference between pixel electrode PE(i,j) and common electrode. As a result, the polarization-conversion effect of the liquid crystal is caused, and the light injected can pass through the liquid crystal display (white state).

(state D=state A) The picture signal is deleted by selecting initialization scanning lines GL_C(i), and making pixel electrode PE(i,j) and common electrode CE(i,j) at the same potential. The liquid crystal returns to the state that the light injected cannot pass through the liquid crystal display apparatus(black state).

By a series of driving waveform, the time-varied transmittivity of the liquid crystal becomes an intermittent type which includes a non-transmission period during one vertical scanning period as shown in FIG. 14. The relationship between the response speed of the liquid crystal, the deterioration of the motion picture, and the transmission period and the non-transmission period during one vertical scanning period, is similar to that of the embodiment 1.

(Embodiment 6)

The difference between the embodiment 5 and the present embodiment 6 is as follows.

Figure 15:
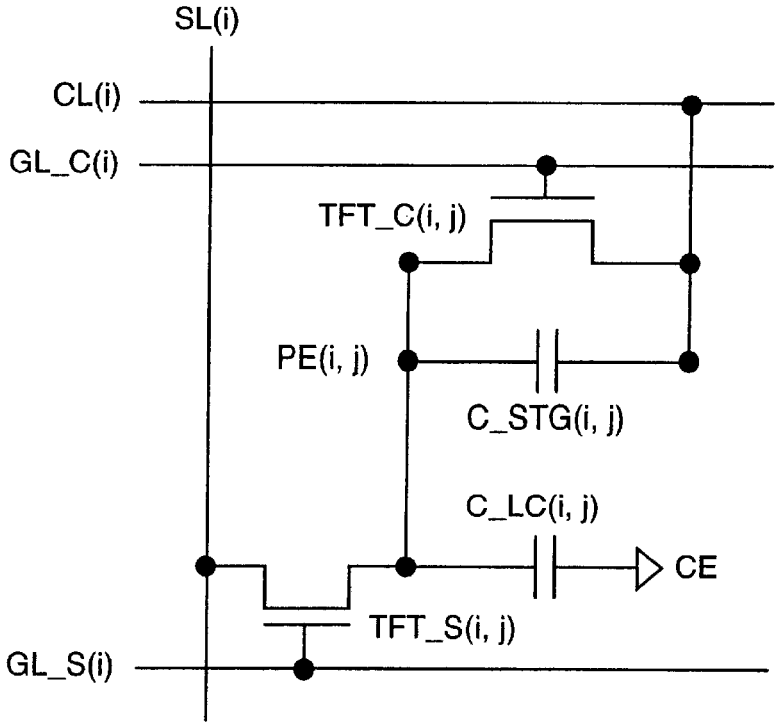
FIG. 15 shows an electric equivalent circuit of the pixel of embodiment 6.

An electric equivalent circuit of the pixel at i-line and j-row formed on the active matrix substrate is shown in FIG. 15.

A source electrode of thin film transistor TFT_S(i,j) for the video signal is connected to video signal line SL(j), its gate electrode is connected to scanning lines GL_S(i) for the video signal line, and its drain electrode is connected to pixel electrode PE(i,j) made of transparent conductive material such as ITO. The source electrode of thin film transistor TFT_C(i,j) for initialization is connected to common line CL(i), its gate electrode is connected to scanning lines GL_C(i) for initialization, and its drain electrode is connected to pixel electrode PE(i,j). The storage capacity C_STG(i,j) is formed between pixel electrode PE(i,j) and common line CL(i). While, the opposed electrode CE made of transparent material such as ITO is formed in the display region on the face of the black matrix substrate opposed to the active matrix substrate, and is connected electrically to the common line CL(i) in the outside of the display region. It is possible to modulate the light passed through the liquid crystal display apparatus, by providing one polarizing plate with the transmission axis being parallel with the orientation direction of the liquid crystal on the face not opposed to each other of one substrate, and another polarizing plate with the transmission axis being orthogonal to the orientation direction of the liquid crystal on the face not opposed to each other of the other substrate in said two substrates. More concretely, the liquid crystal display apparatus becomes of a so-called, normally-black type in which the light does not pass when the voltage is not applied to the liquid crystal, and the light can pass when the electric field is applied to the liquid crystal by providing the potential difference between the pixel electrode and the common electrode.

The driving method, and the relationship between the response speed of the liquid crystal, the deterioration of the motion picture, and the transmission period and the non-transmission period during one vertical scanning period, is similar to those of the embodiment 5.

(Embodiment 7)

Although the configuration is the same as that of the embodiment 1 in the point that a pixel circuit, a pixel structure, and the liquid crystal having a normally black characteristic are used in this embodiment, the driving method of each line to cancel the potential difference applied to liquid crystal 104 is different.

There are the order of selecting scanning line 1011 at the previous stage after selecting scanning line 101, and the order of selecting scanning line 1011 at the previous stage after selecting the scanning line 101, as the selection sequence of the scanning line in the pixel structure of FIG. 16 and in the pixel circuit diagram of FIG. 2. Here, the former is referred as an upper scanning and the latter lower scanning.

In a lower scanning, the second active element 107 first becomes at an on-state, and active element 105 becomes at an on-state after the potential difference applied to the liquid crystal 10 is reduced to be zero. Thereby, the potential of the control signal is writen in liquid crystal 104 and retention volume 106.

On the other hand, although active element 105 previously becomes at an on-state to write the potential of the control signal of signal line 102 in liquid crystal 104 in an upper scanning, the second active element 107 becomes at an on-state immediately after that. As a result, the potential difference applied to liquid crystal 104 becomes to be 0, namely, the liquid crystal display apparatus becomes to be at a black-display-state.

Although a black display is given by applying the selection pulse to the common line in the embodiment 1, the period from the image display to the black display is controlled by controlling two scanning selection sequence with different directions of the scanning like this in this embodiment.

Figure 17:
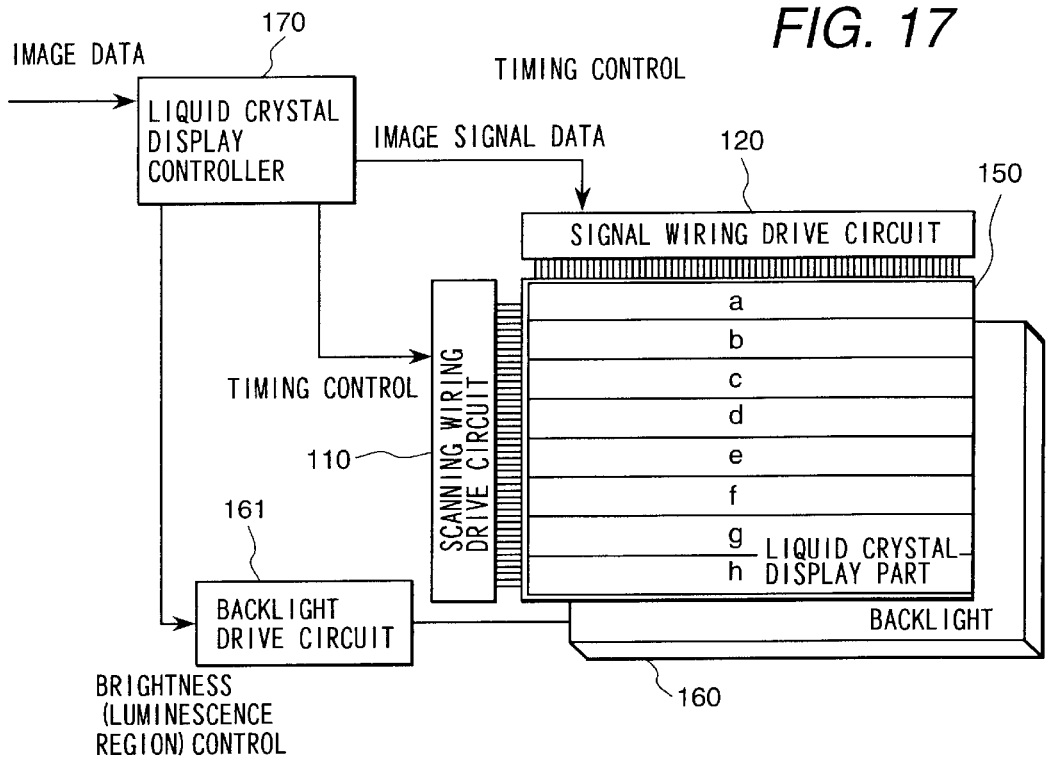
FIG. 17 is a block diagram showing the liquid crystal display apparatus of embodiment 7.

The block diagram of the liquid crystal display apparatus of the present embodiment is shown in FIG. 17. The common line drive circuit is eliminated compared with the configuration of the embodiment 1 (see FIG. 4). As a result, because the PCB substrate for connecting IC and IC used for the common line drive circuit become unnecessary, these cost and the mounting cost, etc. can be decreased.

Figure 18:
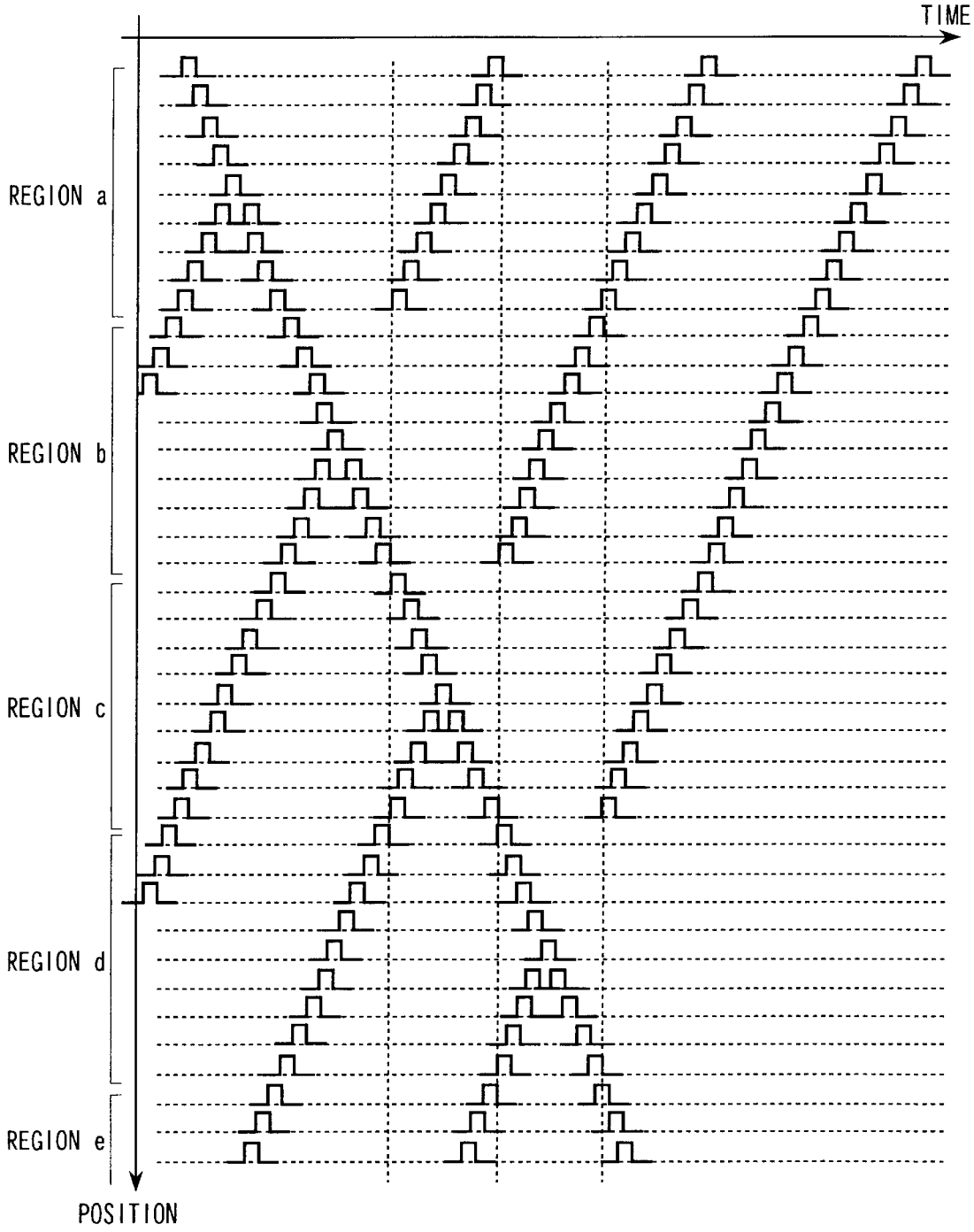
FIG. 18 shows in schematic form the scanning line drive system of the liquid crystal display apparatus of the embodiment 7.

Here, to explain the driving method of the scanning line in this embodiment, liquid crystal display part 150 is divided into, for example, eight upper and lower regions (region a–g). This scanning line drive method is shown in FIG. 18. In this embodiment, each region has nine scanning lines. The axis of abscissa of FIG. 18 indicates time, and the axis of ordinate the selection situation of the scanning line in a certain place (region).

First of all, a lower scanning is started from the uppermost scanning line of the uppermost region a when the display begins. The pixel connected to the scanning line to which the lower scanning is carried out displays the image. Then, the lower scanning of the scanning line in the region b is also carried out continuously after the image is displayed in region a. When this lower scanning reaches the scanning line in the uppermost part of the region c, upper scanning is started from the scanning line in the lowest scanning line of the region a. The image of region a will be deleted from the bottom direction to the up direction according to the upper scanning (deletion by black display). The upper scanning reaches the uppermost part of the region a when the lower scanning reaches region d. Thus while the regions b and c are at an image display state, the region a enters the state of a black display. While lower scanning advances in the region d as it is, and displays the image in the region d, the upper scanning is started from the lowest part of the region b at the same time, and begins to delete the image of region b. Thus, the deletion and the display of an image can be controlled at each region. Here, because the display of the pixel connected to the scanning line becomes strange if the upper scanning started from the lower side of the region b stops on the way, the upper scanning is continued to reach the upper side of the region a or the upper part of the panel. Because the upper scanning started from the region lower than the region a flows together with the lower scanning on the way, it does not reach the region a.

The image display period becomes ¼ vertical period because the region is divided into eight, and the average period until the upper scanning is started after the lower scanning of the scanning line in one region is carried out, is set to be ⅛ vertical period. The ratio of the picture display period to the vertical scanning period 220 can be changed in real time by changing the number of the division of the region and upper scanning generation timing like the embodiment 2.

Figure 19:
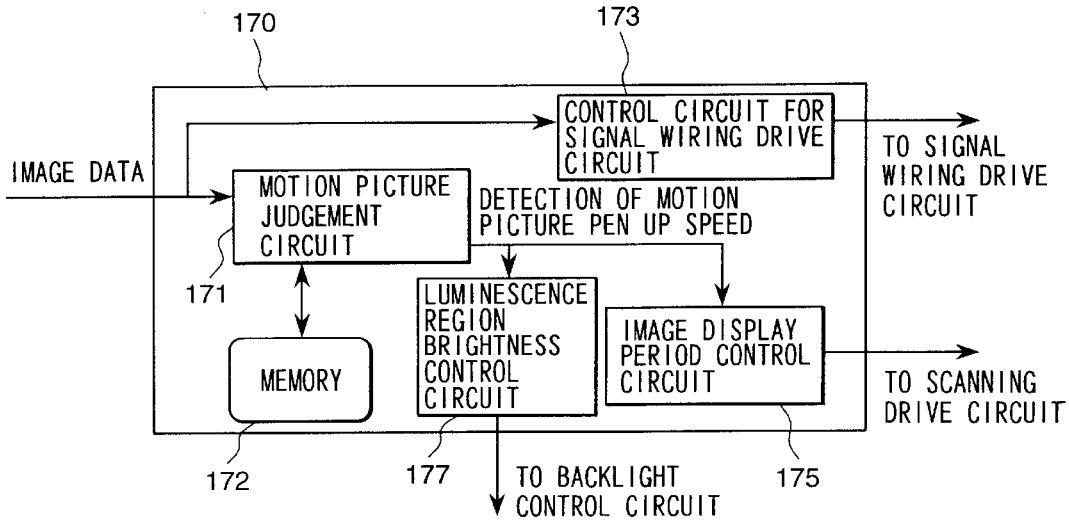
FIG. 19 is a block diagram showing the liquid crystal display controller of the liquid crystal display apparatus of the embodiment 7.

Moreover, liquid crystal controller 170 in this embodiment shown in FIG. 19 can control scanning line drive circuit 110 by judging the pen up speed of the image to be displayed as well as the embodiment 3.

In addition, it is also possible to use the luminescence-region-division type back light as well as embodiment 4.

The parts cost and the product cost can be decreased further because the method of controlling the selection sequence of the scanning line as a drive method of achieving the image display and the deletion (black display) in each pixel in this embodiment.

What is claimed is:

1. A liquid crystal display apparatus comprising:

a pair of substrates, at least one of which is transparent;

a liquid crystal layer interposed between said pair of substrates;

a plurality of first scanning lines and a plurality of signal lines formed so as to cross each other in a matrix form;

a plurality of first active elements, each formed proximate to a crossing point of a corresponding signal line and a corresponding first scanning line, pixel electrodes connected to said first active elements, common lines arranged in parallel with said first scanning lines, and common electrodes connected to said common lines, are arranged on one of said pair of substrates, and a liquid crystal display is provided in the liquid crystal layer by a voltage applied to said pixel electrodes and common electrodes; and a plurality of second active elements connected to said common electrodes, said pixel electrodes corresponding to the common electrodes, and second scanning lines different from said first scanning lines connected through said first active elements to said pixel electrodes, wherein a selection pulse to write an image signal in said pixel electrodes and a selection pulse to display the following image are applied, via one of the first and second scanning lines, and a clear pulse to clear the image signal applied to said pixel electrodes is applied, via the common lines.

2. A liquid crystal display apparatus according to claim 1, wherein said liquid crystal has a black characteristic in which a black display is provided in said liquid crystal layer, when the voltage is not applied to said pixel electrodes and said common electrodes.

3. A liquid crystal display apparatus according to claim 2, wherein said second active elements are composed by extending the pixel electrode length and the common electrode length above said second scanning lines.

4. A liquid crystal display apparatus according to claim 2 or 3, wherein a period from the selection pulse to write the image signal in said pixel electrodes to the selection pulse to clear the image signal applied to said pixel electrodes, is less than 50% of a time interval between the selection pulses.

5. A liquid crystal display apparatus according to claim 2 or 3, wherein a period from the selection pulse to write the image signal in said pixel electrodes to the selection pulse to clear the image signal applied to said pixel electrodes, is less than 25% of a time interval between the selection pulses.

6. A liquid crystal display apparatus according to claim 2 or 3, wherein a period from the selection pulse to write the image signal in said pixel electrodes to the selection pulse to clear the image signal applied to said pixel electrodes, is less than 12.5% of a time interval between the selection pulses.

7. A liquid crystal display apparatus according to claim 4, wherein a response time of said liquid crystal layer is 10 msec or less.

8. A liquid crystal display apparatus according to claim 5, wherein a response time of said liquid crystal layer is 5 msec or less.

9. A liquid crystal display apparatus according to claim 6, wherein a response time of said liquid crystal layer is 3 msec or less.

* * * * *